US005579949A

United States Patent [19]

Dykes et al.

[11] Patent Number: 5,579,949

[45] Date of Patent: Dec. 3, 1996

[54] INSULATIVE "C" SHAPED SLEEVE FOR BEVERAGE CUP

[76] Inventors: Scott H. Dykes, 3020 Parkwood Ct., Carmichael, Calif. 95608; Kenneth Tarlow, 94 Birch Ave., Corte Madera, Calif. 94925; Paul Ferrari, 6434 Palm Dr., Carmichael, Calif. 95608; Felix F. Porta, 1478-A California St., San Francisco, Calif. 94109

[21] Appl. No.: 538,273

[22] Filed: Oct. 2, 1995

[51] Int. Cl.[6] ..... B65D 25/34

[52] U.S. Cl. ..... 220/739; 220/903

[58] Field of Search ..... 220/739, 903; 215/100.5, 12.1

[56] References Cited

U.S. PATENT DOCUMENTS 5,147,067 9/1992 Effertz ..... 220/739

5,325,991 7/1994 Williams ..... 220/739

5,390,804 2/1995 Beggins ..... 220/739

5,427,285 6/1995 Kreitzman ..... 220/739

*Primary Examiner*—Joseph M. Moy

[57] ABSTRACT

A "C" shaped sleeve for insulating the hand while holding a beverage cup. A plastic molded shape having two broadened ends connected by a thinner central strip wherein the boky is conically arrayed about an axis which intersects the center of the shape. The "C" shape is sizewd to be slightly under the diameter of a conventional hot beverage cup and to snap onto the sidewall of the beverage cup and hold in a spring like fashion.

7 Claims, 7 Drawing Sheets

INSULATIVE "C" SHAPED SLEEVE FOR BEVERAGE CUP

FIELD OF INVENTION

The present invention relates to a sleeve that insulates the hand while holding a hot beverage cup.

BACKGROUND OF THE INVENTION

Various types of insulating jackets for beverage containers are known in the art, such as that disclosed by the Tumberg (U.S. Pat. No. 4,548,349) and Carlson (U.S. Pat. No. 5,222,656). These designs have several drawbacks. One is that the sleeves are of a tubular design which slip onto the cup. They have no spring tension in them to help them stay on the upper perimeter of the cup, so, unless specifically held in place by the user, the sleeve tends to fall to the bottom of the cup. This can cause inconvenience when the user sets the cup down and then attempts to pick it up again. Another drawback to the current art is that the materials used tend to be expensive relative to the end use. Currently coffee shops such as Starbucks use a second paper cup as an insulating sleeve. The cost of the cup is about 4 cents. Therefore, the cost of an insulating band should be less than 4 cents. Another problem with the current art is that the insulating sleeves don't stack compactly. The modest taper of the walls of the paper cups mean that when the relatively thick walled insulating sleeves nest one on top of the other, they take up an excessive mount of space. Some sleeves are shipped flat and assembled on site but this adds time to beverage preparation.

SUMMARY OF INVENTION

An object of the present invention is to provide an insulated sleeve for a paper beverage cup which hugs the upper wall of the beverage of the beverage cup and has built in spring tension which causes the insulated sleeve to remain in place at the top perimeter of the cup. Another object of the present invention is to provide an insulated sleeve for a beverage cup which is inexpensive to manufacture and preferably costs less than a paper cup which is currently used by coffee shops to act as insulator. Another object of the present invention is to provide an insulated sleeve which nests compactly so that the sleeves take up a minimum of space at the beverage preparation area. Accordingly, the present invention is a plastic molded "C" shape which has opposing broad portion large enough to accommodate the thumb on one side and the forefinger and middle finger on the other side, connected by a thinner connecting band. The broad portions have raised islands which create an air space between the plastic sleeve and the hot beverage cup thereby insulating the users fingers from the hot beverage container. the inside diameter of the "C" shape is slightly less than that of a conventional paper coffee cup which creates a spring like tension about the top perimeter of the paper cup. The upper edge of the broad portion is tapered inward to fit under the lid of a standard paper beverage cup, thereby reducing the chance that the "C" shaped holder will slide off. The opposing broad portions are pre-stressed to a 25° angle to allow for compact stacking. The "C" shape allows two stacks of holders to interlink with one another.

BRIEF DESCRIPTIONS OF THE DRAWINGS

FIG. 5 is a section view showing what two "C" shaped sleeves of the present invention look like when there is no pre-stressed twist built in.

FIG. 6 is a section view showing when there is a pre-stressed twist built in.

DETAILED DESCRIPTION OF DRAWINGS

Figure 1:
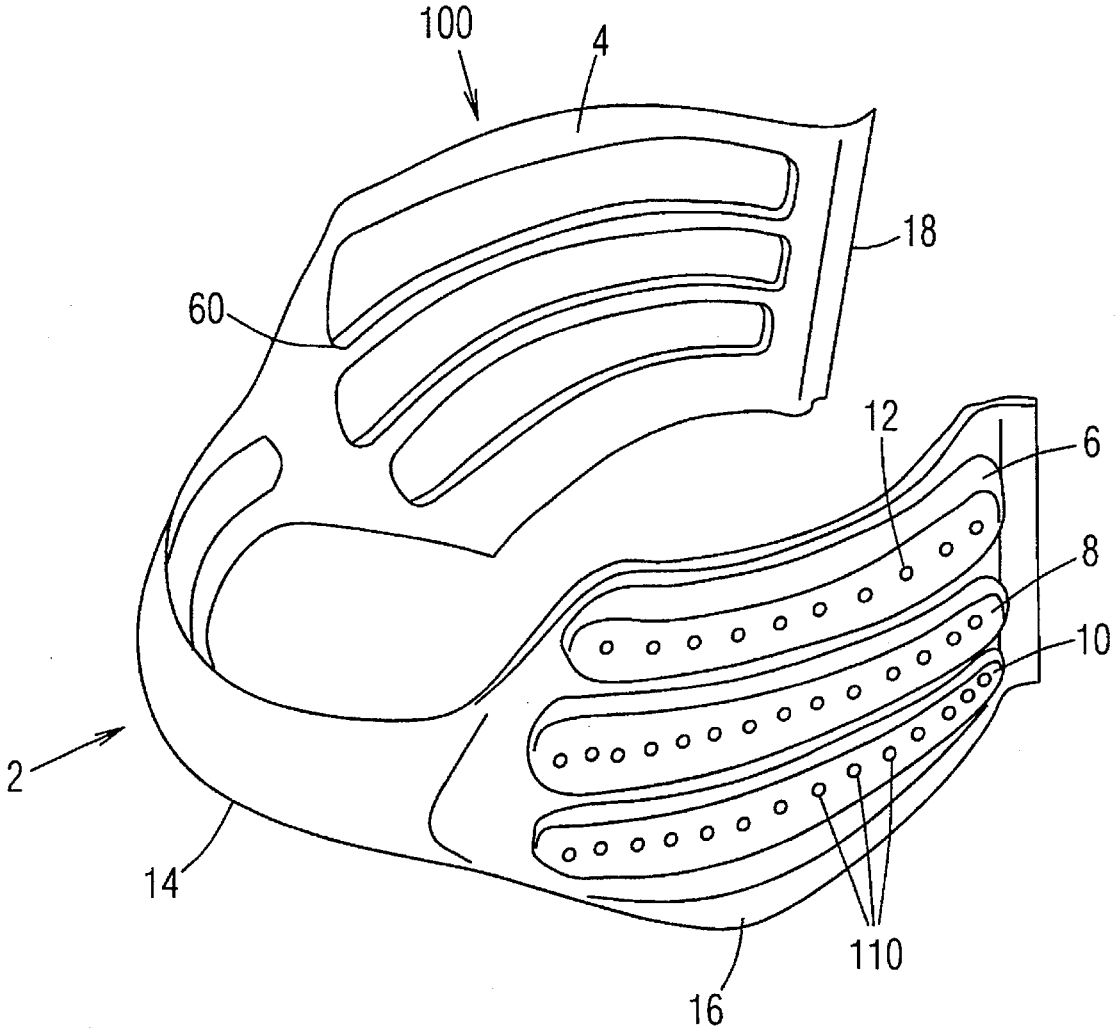
FIG. 1 is a side view of the "C" shaped sleeve of the present invention mounted on the top side surface of a beverage cup.
Figure 2:
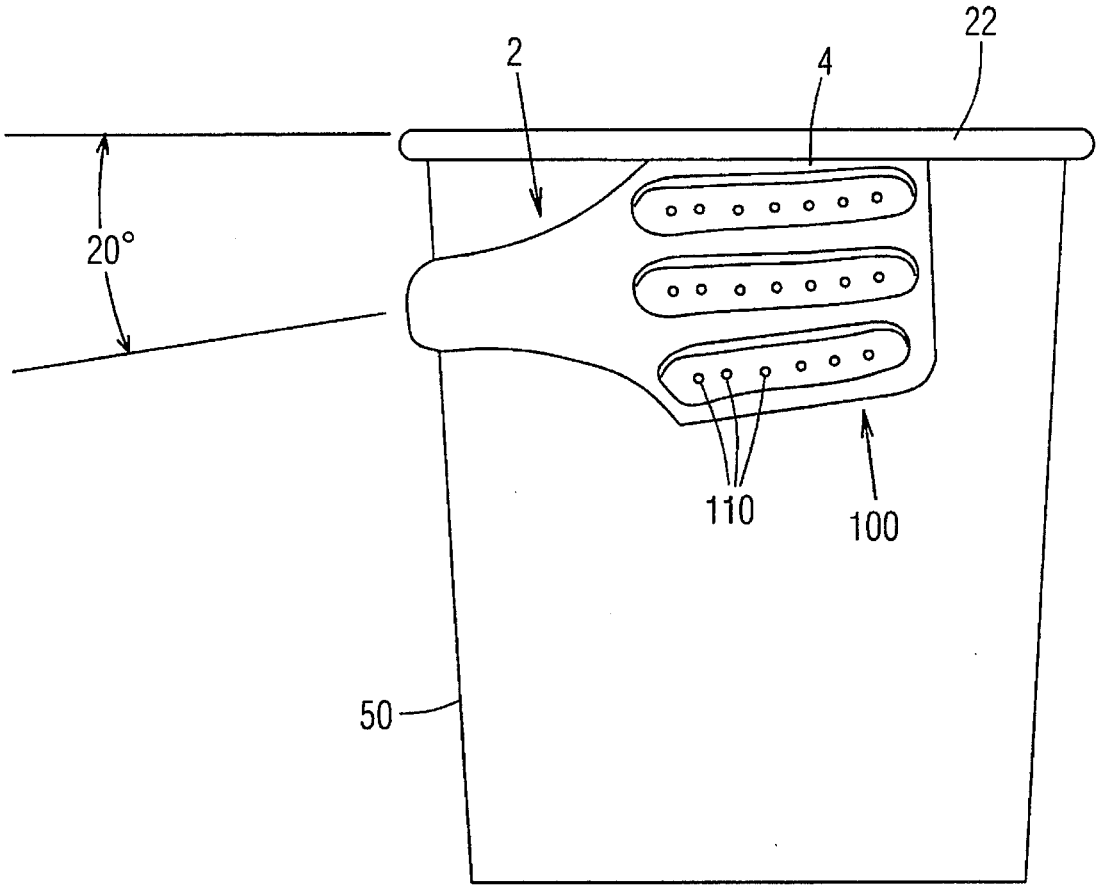
FIG. 2 is a front view of the present invention showing a users fingers being insulated.

Referring now to FIG. 1: "C" shaped sleeve 2 is a plastic semi rigid molded device of two identical opposing broad surfaces 100 connected by a curved thin member. The outermost vertical edge 18 of the broad curved surface 100 is angled away from the curve of the broad surface 100 to facilitate snapping the "C" shaped sleeve 2 onto a beverage cup. The broad surface 100 has a plurality if indentations 60 running longitudinally creating a plurality of raised islands 6,8,10. These raised islands 6,8,10 create an air space underneath them which insulates a persons fingers from the surface of the hot beverage cup 50 as shown in FIG. 2. The top lip of broad surface 100 is angled to match the angle of the lip of beverage cup 50. The approximate angle amount 20 shown in FIG. 2. When edge 4 of broad surface 100 is captured under lip 22 of beverage cup 50 it prevents the "C" shaped sleeve 2 from slipped off of cup 50.

Figure 3:
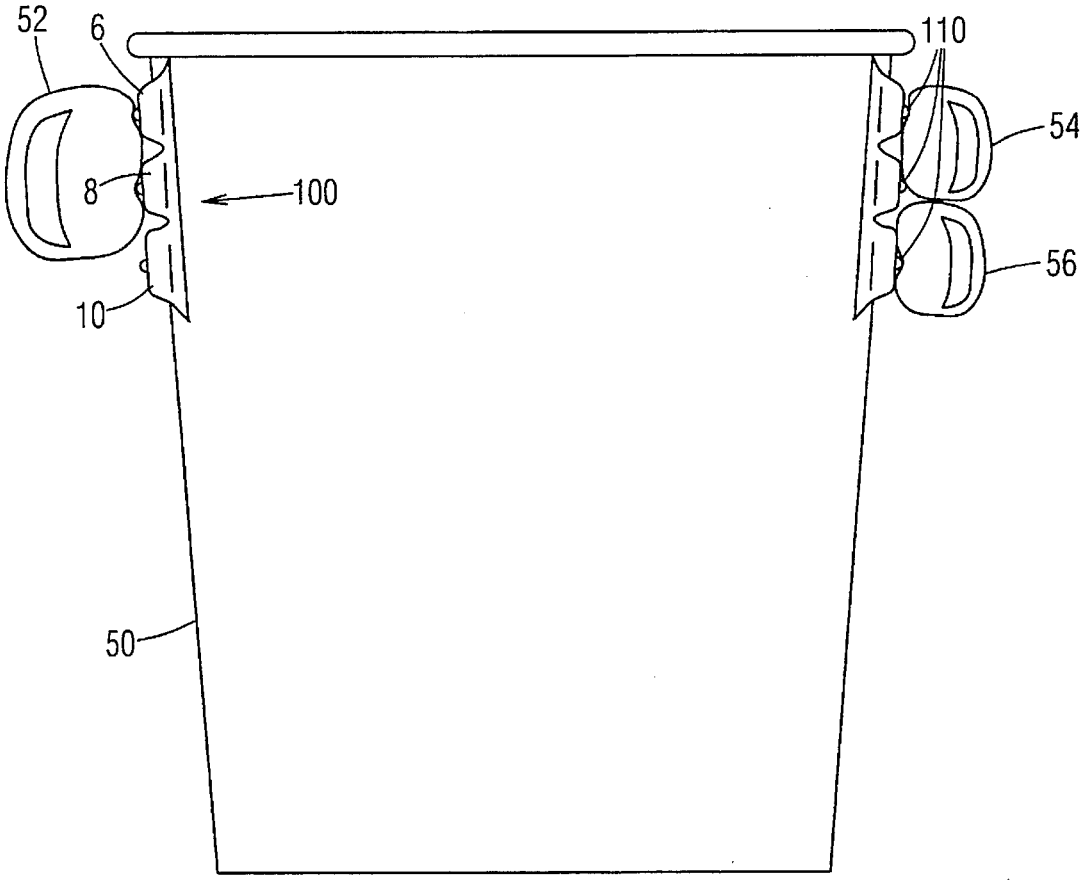
FIG. 3 is a perspective view of the "C" shaped band of the present invention.

FIG. 3 shows how a person's thumb 52 and opposing forefinger 54 and middle finger 56 relate to islands 6,8,10 located on broad surface 100. A plurality of small bumps 110 help maintain a now slip grip by the user.

Figure 4:
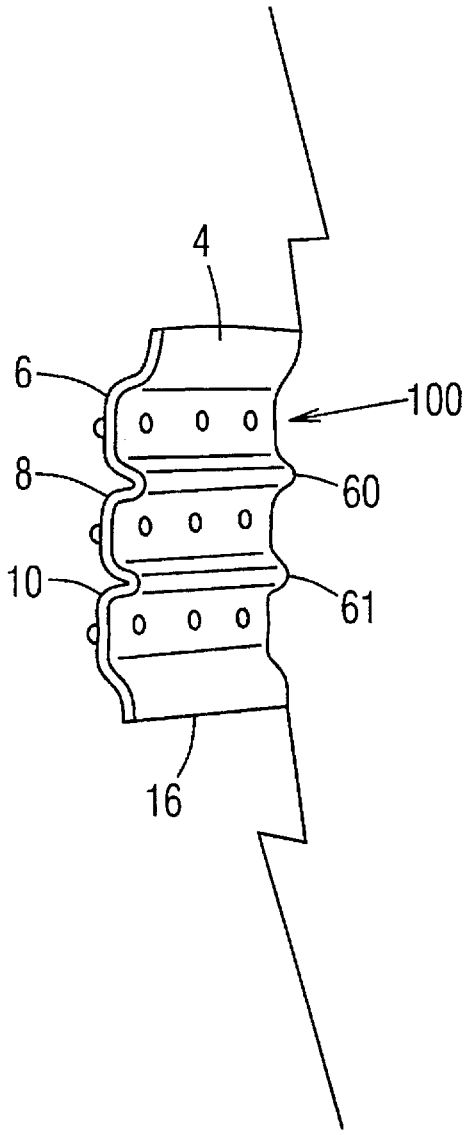
FIG. 4 is a section view of one of the broad plastic molded surfaces.

FIG. 4 is a section view of broad surface 100 clearly showing the indentations 60,61 and resulting raised surfaces 6,8,10 which cause a person's fingers to be insulated from the heat of a hot beverage cup.

Top 4 and bottom edges 16 are identical so the "C" shaped sleeve may be snapped onto cup 50 right side up or upside down.

Figure 5:
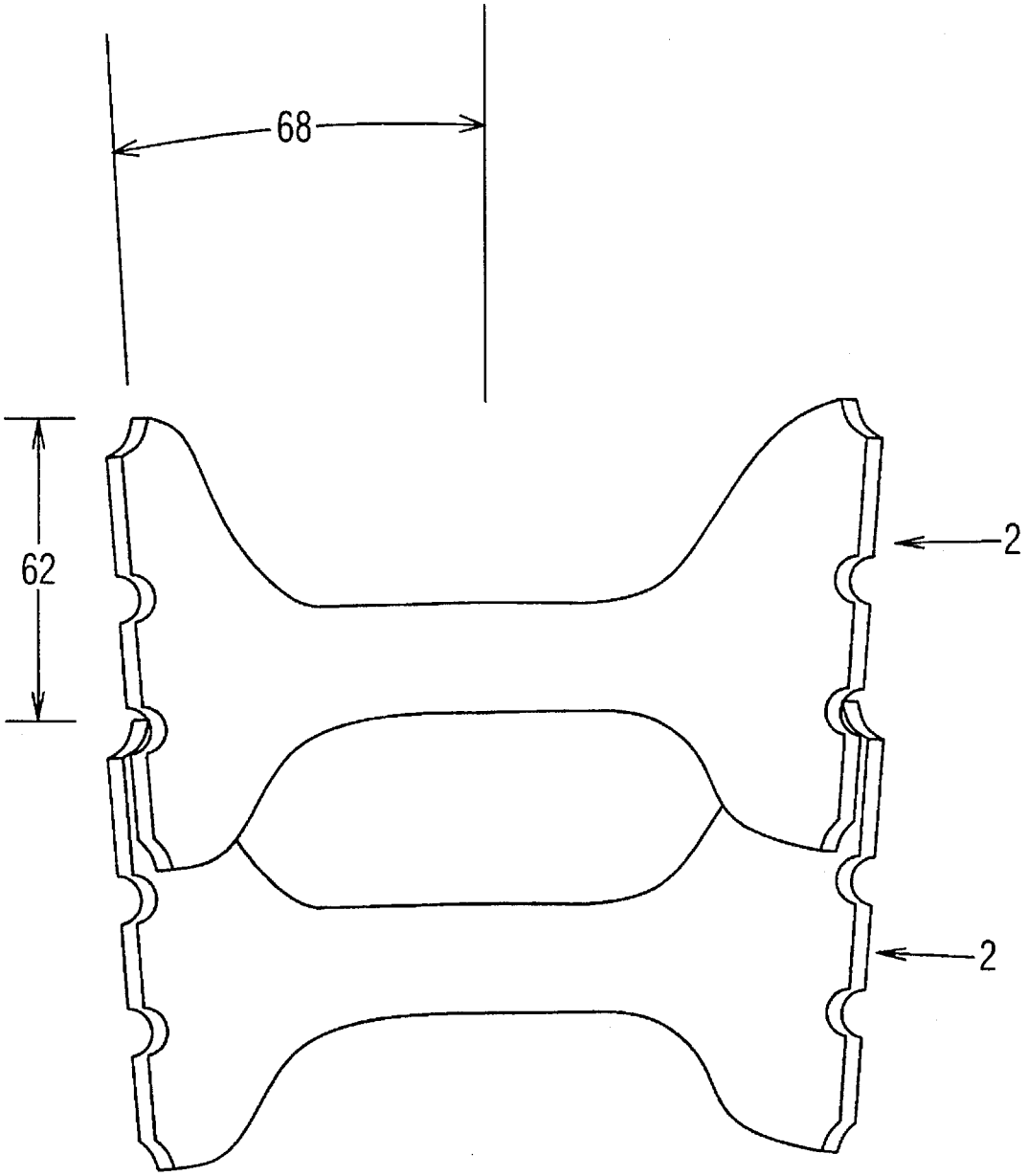

FIG. 5 shows how the present invention would stack if it did not have a pre-stressed angle the distance 62 between one stacked "C" shaped sleeve 2 and another is approximately 1.5 inches 62 which created inefficient stacking.

Figure 6:
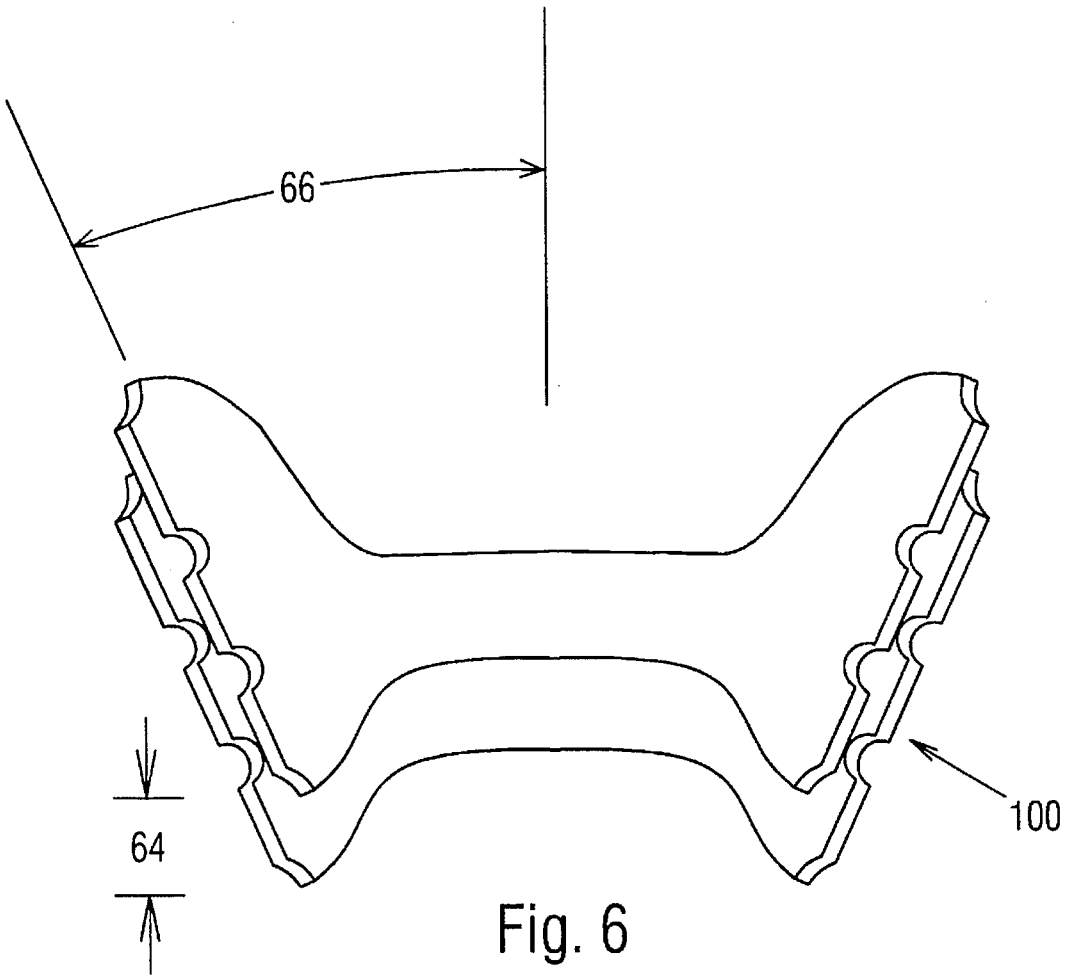
Figure 7:
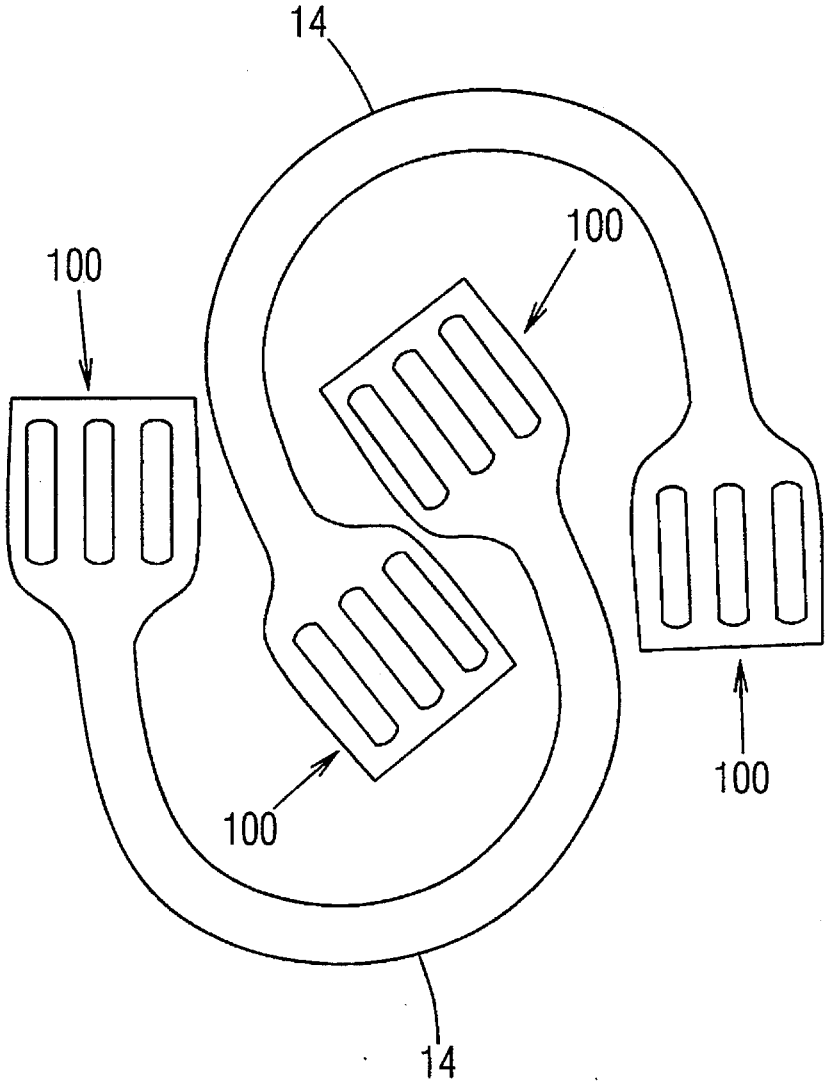
FIG. 7 is a top view of the present invention showing two "C" shaped sleeves interlaced.

FIG. 6 shows how the present invention actually stacks because of the pre stressed angle 66 built into broad surface 100. This angle 66 creates a more compact nesting height between sleeves of approximately 0.425 inches as shown in 64. The nesting efficiency is effectively doubled when one "C" shaped sleeve 2 is interlaced with another "C" shaped sleeve 2 as shown in FIG. 7. While the preferred embodiment of the invention has been illustrated and described, it will be appreciated that various changes can be made therein without departing from the spirit and scope of the invention.

The embodiment of the invention in which an exclusive property or privilege is claimed are defined as follow:

1. A "C" shaped sleeve for insulating a hand while holding a sidewall of a hot beverage cup, said sleeve comprising a "C" shaped body of rigid yet resilient material having opposing broad ends connected by a less broad center band wherein the body is cortically arrayed about a central axis and is sized to conform in a friction fit relationship with said sidewall of said beverage cup when said "C" shaped sleeve is snapped onto said sidewall of said beverage cup.

2. A "C" shaped sleeve of claim 1 wherein said broad ends are prestressed to approximately a 25 degree angle to facilitate stacking of said sleeves, said prestressed broad ends being twisted to a 5 degree angle when forced to the surface of said sidewall.

3. A "C" shaped sleeve of claim 1 wherein said broad ends have a plurality of raised islands creating an insulating air space between the inside surface of said broad ends and the outside surface of said beverage cup.

4. A "C" shaped sleeve of claim 1 wherein the surface of said islands of said broad ends contain a plurality of raised friction bumps.

5. A "C" shaped sleeve of claim 1 wherein the upper edge of said broad surfaces is tapered inward to engage the underside of the lip of said beverage cup.

6. A "C" shaped sleeve of claim 1 wherein the outermost edges of said broad surfaces are tapered outward to facilitate the application of said "C" shaped sleeve to said beverage cup.

7. A "C" shaped sleeve of claim 1 wherein the entire assembly is injection molded of thin walled plastic to achieve minimum cost per part.

* * * * *